US006015128A

United States Patent [19]

Lombardi

[11] Patent Number: 6,015,128

[45] Date of Patent: Jan. 18, 2000

[54] PERCUSSION BELL CLAMPING SUPPORT

[75] Inventor: Donald G. Lombardi, Thousand Oaks, Calif.

[73] Assignee: Drum Workshop, Inc., Oxnard, Calif.

[21] Appl. No.: 09/268,059

[22] Filed: Mar. 15, 1999

[51] Int. Cl.[7] ..... G10D 13/08

[52] U.S. Cl. ..... 248/421; 84/421; 248/218.4; 248/229.13

[58] Field of Search ..... 84/402, 406, 411 R, 84/421, 327; 248/229.1, 229.11, 229.13, 218.4

[56] References Cited

U.S. PATENT DOCUMENTS

| | | | |
|---|---|---|---|
| 487,165 | 11/1892 | Straley | 248/229.1 |
| 1,330,814 | 2/1920 | Meyer | 84/411 R |
| 3,096,109 | 7/1963 | Callahan | 287/54 |
| 3,326,074 | 6/1967 | Osty et al. | 84/411 R |
| 3,433,115 | 3/1969 | Kjelstrom | 84/411 R |
| 4,729,535 | 3/1988 | Frazier et al. | 248/230 |
| 4,981,065 | 1/1991 | Cohen | 84/402 |
| 5,645,253 | 7/1997 | Hoshino | 248/181.1 |
| 5,684,258 | 11/1997 | Liao | 84/421 |
| 5,703,306 | 12/1997 | Liao | 84/421 |

OTHER PUBLICATIONS

Latin Percussion Catalog, p. 4, Jan. 1975.

*Primary Examiner*—Robert E. Nappi
*Assistant Examiner*—Wesley Scott Ashton
*Attorney, Agent, or Firm*—William W. Haefliger

[57] ABSTRACT

A percussion bell support includes a base connected to the bell head end, a jaw swingably attached to the base, surfaces on the base and jaw to clamp to a support member, when the jaw is swung toward the base and head end of the bell, a connector shank passing through the jaw and into the base, and a handle, the jaw remaining between the handle and base during swinging of the jaw and during handle and shank rotation to tighten the jaw and base to the support member.

9 Claims, 3 Drawing Sheets

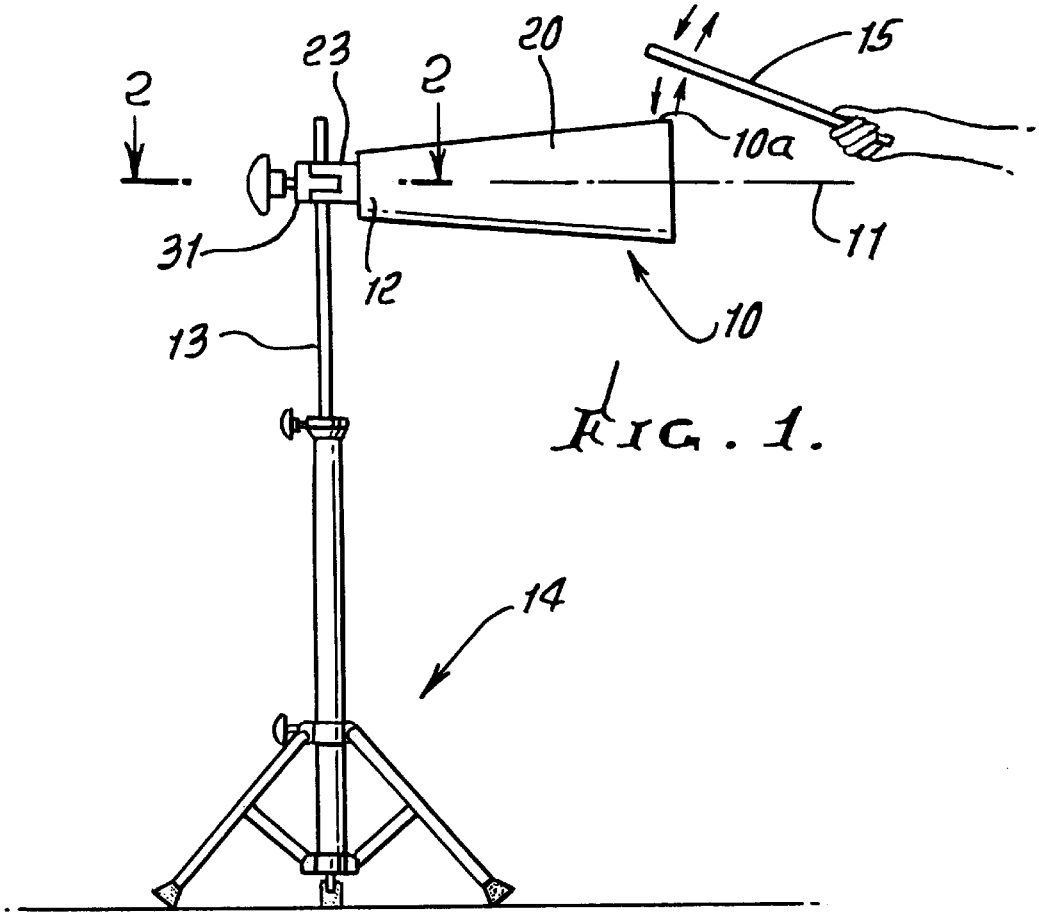
FIG. 1.
FIG. 2.
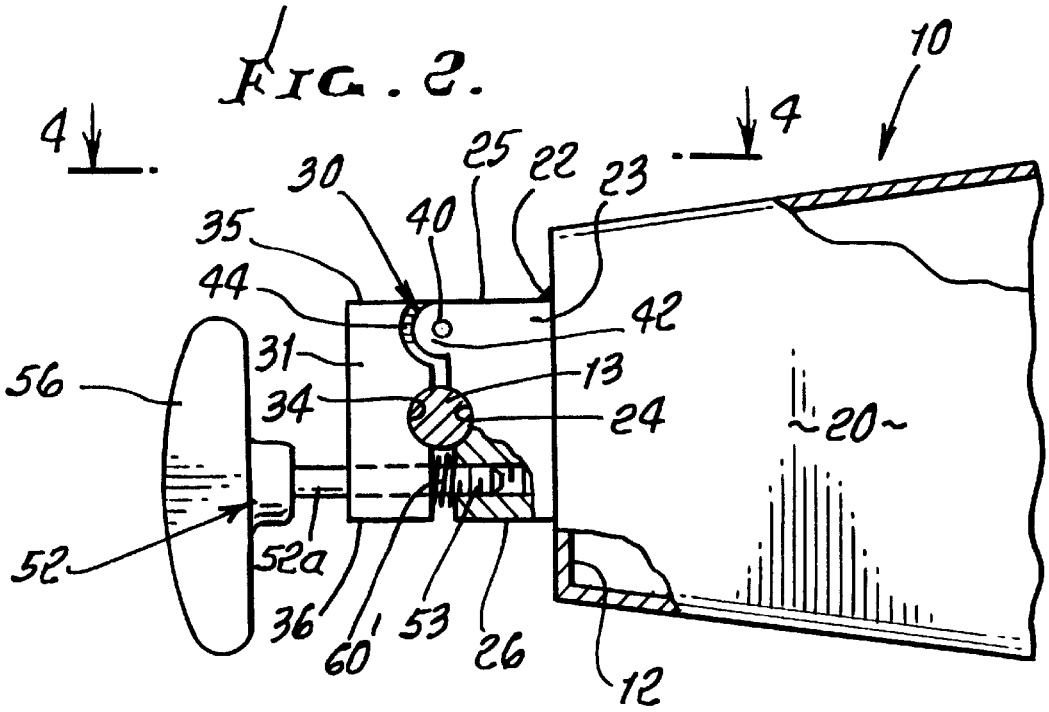

PERCUSSION BELL CLAMPING SUPPORT

BACKGROUND OF THE INVENTION

This invention relates generally to improvements in percussion instruments and their supports, and more particularly to supports for metallic bell percussion instruments, having horn shaped bodies projecting from supported ends.

In the past, bell type percussion instruments were supported by tightenable structures, such as set screws, that tended to loosen due to vibration of the bell resulting from drum stick repeated impact on the instrument. As a result, the drummer was faced with having to reach downward or forward at frequent intervals, and re-tighten the support structure. There is need for a mechanism which supports the head end of the relatively heavy metallic bell in a forwardly diverging position of the bell, and which does not tend to loosen during a performance.

SUMMARY OF THE INVENTION

It is a major object of the invention to provide an improved support for a metallic, bell shaped percussion instrument, having a head and a skirt projecting and flaring away from the head. Basically, the support comprises:

a) clamp base for supporting the head, b) a clamp jaw attached to the base, c) adjustable connector structure connecting the jaw to the base for opening and closing the jaw away from and toward the base, d) and clamping surfaces carried on the jaw and base to be clamped against a support member in response to tightening adjustment of the connector structure.

As will be seen, a spring may be provided to urge the clamp jaw away from the base to facilitate loosening of the connector structure and its disconnection from a support member, such as a rod.

Another object includes provision of a pivot connecting the jaw to the base, and in such a way that the clamping surfaces that engage the support rod are located between the pivot and the adjustable connector, whereby maximum clamping pressure and friction may be developed, as by mechanical advantage. Such pressures are preferably transmitted to cylindrically concave clamping surfaces for maximum frictional engagement area with the support rod.

Yet another object is to provide the head to have lateral length dimensions and width dimensions less than said lateral length dimension, the clamping surfaces being elongated in directions parallel to head width dimensions. In this way, the clamped support rod does not project in interfering relation with the percussion bell skirt, and the clamping surfaces can be elongated widthwise of the head, for distributed frictional engagement and loading, the weight of the shell acting to "cock" the clamping surfaces relative to the rod, for increasing frictional retention effect.

A further object is to provide interengageable threads in the base and on said connector, the connector projecting generally normal to the head and having a tightenable handle projecting at the side of the jaw opposite the head.

An additional object is provision of a non-metallic striker part attached to the skirt to be presented outwardly, to be rythmically and repeatedly struck by a drum stick, during a musical performance, to reduce stick wear.

These and other objects and advantages of the invention, as well as the details of an illustrative embodiment, will be more fully understood from the following specification and drawings:

DRAWING DESCRIPTION

FIG. 1 is an elevation showing a percussion bell supported on a rod and stand, to be struck by a drum stick;

FIG. 2 is an enlarged top plan view taken on lines 2—2 of FIG. 1;

DETAILED DESCRIPTION

Figure 5:
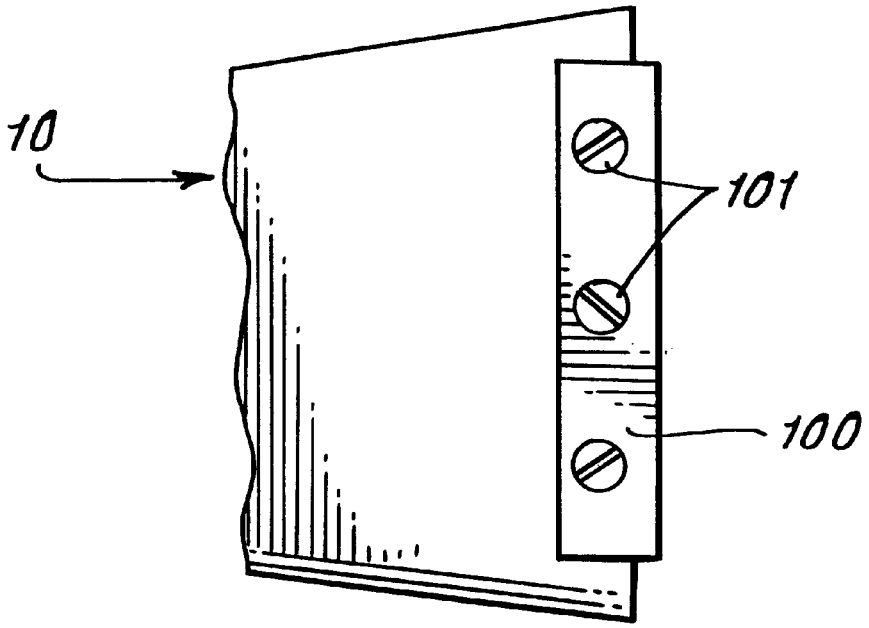
FIG. 5 is a fragmentary view of a bell end, carrying a stick wear plate.

The drawings show a metallic bell 10, in the shape for example of a cow bell; and in FIG. 1 the bell projects and flares laterally and defines a lateral substantially horizontal axis 11. The bell has a head end 12 supported by an upright rod 13 carried by a support stand 14. The elements 10, 12, 13 and 14 may take various forms or configurations. A drum stick 15 is shown being hand manipulated to repeatedly strike the end or top edge 10*a* of the bell. A wear plate 100 may be attached as by fasteners 101 to the bell wall, at its end, to be struck by the stick 15, to prevent stick breakage and/or wear. See FIG. 5.

Figure 3:
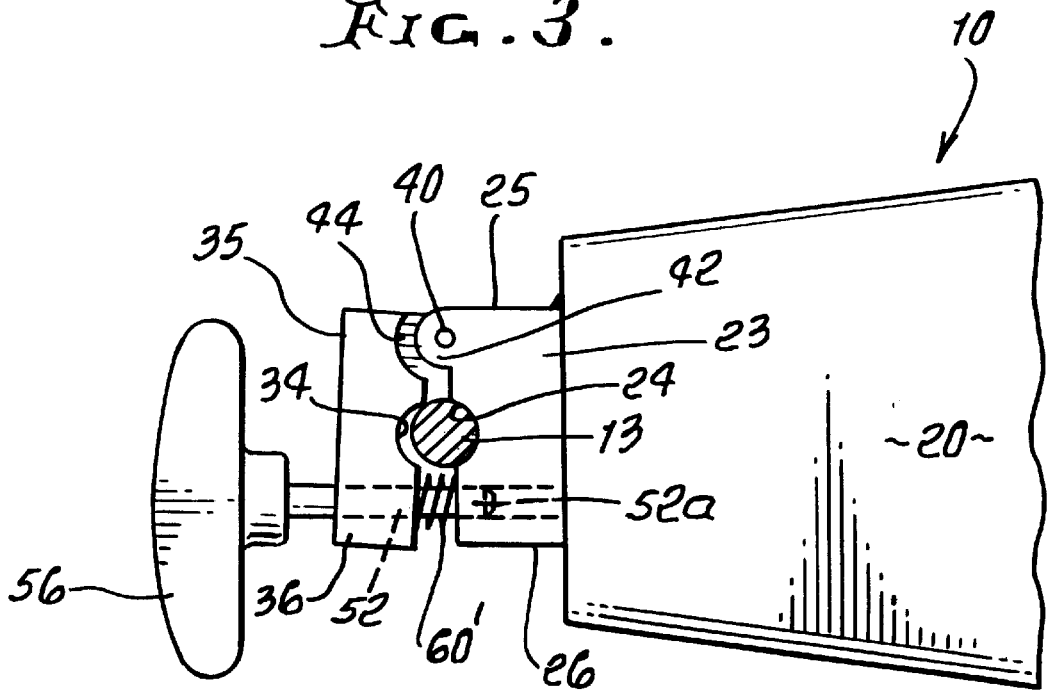
FIG. 3 is a view like FIG. 2, with a clamp loosened, to allow vertical adjustment of the bell support on the rod.
Figure 4:
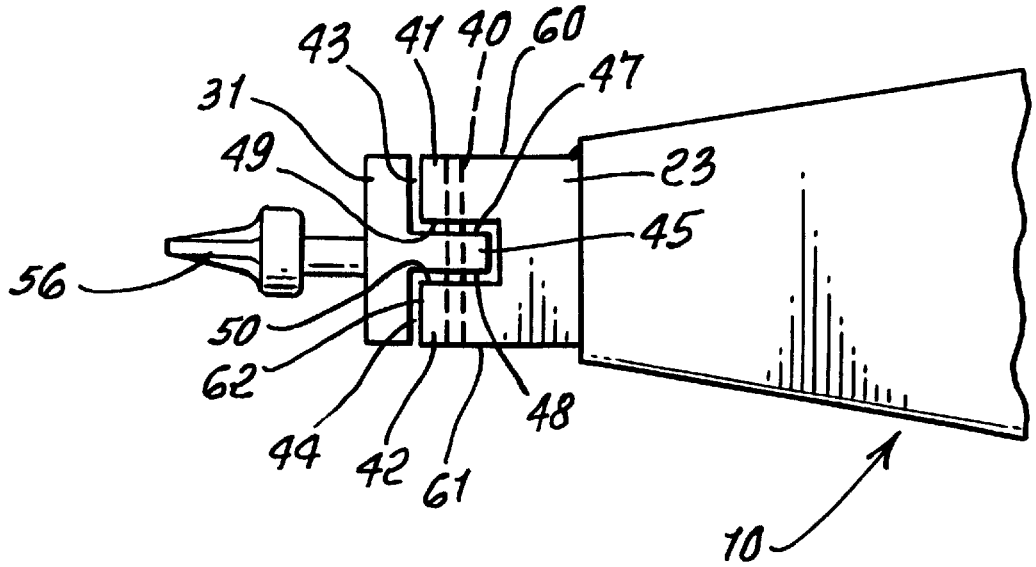
FIG. 4 is a view taken on lines 4—4 of FIG. 2.

Referring to FIGS. 2–4, the hollow bell shell 20 has a head end 12. Attached as by weld 22 or other means to the head end 12 is a block shaped clamp base 23, for supporting the bell. As shown, the base has a flat side engaging the head end. In FIG. 2 the support rod 13 projects adjacent the cylindrically concave clamping surface 24 on the base 23, intermediate its opposite ends 25 and 26. For best results, surface 24 extends through an angle between 0° and 180° relative to the cylindrical surface of the rod, as seen in FIG. 2.

Attached to the base 23, as at location 30, is clamping structure such as a block shaped clamp jaw 31, for clamping the rod between the jaw and base. In FIG. 2, the support rod also projects adjacent the concave clamping surface 34 on the jaw 31, intermediate its opposite ends 35 and 36. Surface 34 may typically be cylindrically concave. Surface 34 may also, for best results, extend through an angle of between 90° and 180° relative to the cylindrical surface of the rod, as seen in FIG. 2.

Adjustable connector structure is provided to connect the jaw to the base, for opening and closing the jaw away from and toward the base.

As shown in FIGS. 2–4, a pivot pin 40 supports the jaw for pivoting relative to the base, near end 25 of the base. In the specific example, the jaw pivots hingedly toward and away from the base, and toward and away from the rod 13. One of the two block shaped bodies 23 and 31 has two trunnions, and the other of the bodies has a tongue projecting between the trunnions, the pin 40 passing through the medial tongue 45 and into openings in the two trunnions, to provide a hinge. As shown, base body 23 has trunnions 41 and 42 integral therewith and projecting toward the jaw 31, as into jaw recesses 43 at opposite sides of a tongue 45. The tongue projects between the two trunnions. See FIG. 4. Flat opposite sides 47 and 48 of the tongue are closely adjacent flat inner sides 49 and 50 of the trunnions, to provide bearing or guide surfaces assisting the blocking of lateral loosening of the jaw during swinging.

Figure 6:
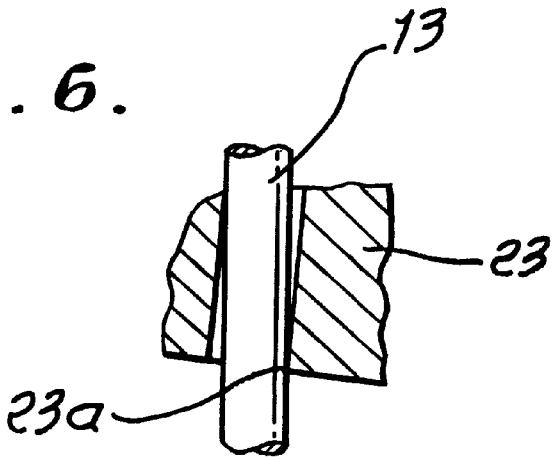
FIG. 6 shows a "cocked" condition, as referred to below.

An adjustable connector 52 connects the jaw to the base for pivotally swinging the jaw toward and away from the base. The connector has a shank 52*a* passing through the jaw block and into the base block 23. Threads 53 on the shank and in a bore on block 23 may be relatively rotated, by turning of handle 56, to tighten clamping surfaces 24 and 34 against the rod. Since the connector is at the opposite side of the rod, relative to the pivot, maximum mechanical advantage is provided for rigidly clamping the bell to the rod, by turning handle 56 and preventing its inadvertent loosening to an extent preventing unclamping of the rod, all within the confines of an overall compact and heavy duty block configuration. Even though handle may be slightly loosened the clamping surfaces 24 and 34 and their edges angularly "cock" relative to the rod, due to weight and tongue imposed by the bell, to prevent sliding of the bell down the rod. FIG. 6 shows a cocked condition as referred to, with edge 23*a* of body 23 frictionally engaging rod 13. In this regard, the head end has lateral length dimensions, and width dimensions less than said lateral length dimensions, said clamping surfaces being elongated in directions parallel to head end width dimensions. See in this regard block opposite sides 60 and 61 in FIG. 4, and top 62.

A spring 60 is provided in the gap between the blocks 23 and 31 to act between the base block and jaw, to urge the jaw away from the base, as during intentional loosening of the connector.

I claim:

1. A percussion bell clamping support connected to a percussion bell having a head end and a skirt projecting and flaring away from the head end, comprising:

a) a clamp base adjacent to and supporting the head end, the base having a flat side engaging the percussion bell head end to directly support said head end, b) a clamp jaw facing the clamp base, c) adjustable connector structure connecting the jaw to the base for opening and closing the jaw away from and toward the base, d) and clamping surfaces carried on the jaw and base to be clamped against an upright support member in response to tightening adjustment of said connector structure, said clamping surfaces being concave toward said support member, e) said connector structure including connectors at least one of which is attached to the base for swinging the jaw toward and away from the base and bell head end, said one connector having a shank passing through the clamp jaw and into the base, toward said head end, said one connector having a handle, said jaw located between and remaining between said handle and said base during said swinging of the jaw and during rotation of the shank by the handle effecting said tightening adjustment.

2. The percussion bell clamping support connected to a percussion bell percussion bell claim 1 including a spring urging the jaw in a pivoting direction away from the base.

3. The percussion bell clamping support connected to a percussion bell as recited in claim 1 wherein another connector provides a pivot connecting the jaw to the base, said clamping surfaces located between said pivot and said one connector.

4. The percussion bell clamping support connected to a percussion bell as recited in claim 1 wherein said head end has lateral length and width dimensions less than said lateral length dimension, said clamping surfaces being elongated in the direction parallel to head end width dimension, and lengthwise of the support member.

5. The percussion bell clamping support connected to a percussion bell as recited in claim 4 wherein said clamping surfaces are cylindrically concave toward one another, and elongated widthwise.

6. The percussion bell clamping support connected to a percussion bell as recited in claim 1 including said support member in the form of a rod clamped between said clamping surfaces, whereby the bell skirt projects away from said support member, and exerts torque tending to cock said clamping surfaces relative to the rod, preventing sliding of the clamping surfaces downwardly on the rod, in the event of slight loosening of said connector structure.

7. The percussion bell clamping support connected to a percussion bell as recited in claim 1 wherein said skirt is metallic, and including a non-metallic part attached to said skirt to be presented outwardly, to be rythmically and repeatedly struck by a drum stick.

8. The percussion bell clamping support connected to a percussion bell as recited in claim 1 including interengageable threads in the base and on said connector structure, the connector structure projecting generally normal to the head end, and said tightenable handle projecting at the side of the jaw opposite the head end.

9. The percussion bell clamping support connected to a percussion bell as recited in claim 1 wherein said clamp base is in the form of a first block attached to the head end, said clamp jaw is in the form of a second block, one block having two trunnions, and the other block having a tongue projecting between the trunnions, there being a pivot pin passing through the tongue and into the trunnions, the pivot pin defining an axis extending in offset skew relation to the support member, said blocks defining an overall compact block configuration having opposite ends, opposite sides, and a top spaced from the head end.

* * * * *